US009470224B2

(12) United States Patent
Ban et al.

(10) Patent No.: US 9,470,224 B2
(45) Date of Patent: Oct. 18, 2016

(54) PISTON TYPE COMPRESSOR

(71) Applicant: KABUSHIKI KAISHA TOYOTA JIDOSHOKKI, Aichi-ken (JP)

(72) Inventors: Takahisa Ban, Kariya (JP); Koji Kawamura, Kariya (JP); Yoshio Kimoto, Kariya (JP); Kengo Sakakibara, Kariya (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 268 days.

(21) Appl. No.: 14/058,524

(22) Filed: Oct. 21, 2013

(65) Prior Publication Data

US 2014/0127061 A1 May 8, 2014

(30) Foreign Application Priority Data

Nov. 2, 2012 (JP) ..... 2012-243161

(51) Int. Cl.

*F04B 49/24* (2006.01)
*F04B 27/10* (2006.01)
*F04B 1/18* (2006.01)
(Continued)

(52) U.S. Cl.

CPC ..... *F04B 49/24* (2013.01); *F04B 1/184* (2013.01); *F04B 27/1018* (2013.01); *F04B 27/1027* (2013.01); *F04B 27/1081* (2013.01); *F04B 39/123* (2013.01); *F04B 7/0003* (2013.01)

(58) Field of Classification Search

CPC ..... F04B 27/1045; F04B 27/1036; F04B 27/1009; F04B 49/24; F04B 27/1018; F04B 27/1027; F04B 27/1081; F04B 27/109; F04B 27/10; F04B 27/16; F04B 2027/1872; F04B 2027/1886; F04B 2027/1895; F04B 39/08; F04B 39/10; F04B 1/18; F04B 1/184; F04B 7/0003; F04B 7/0007; F04B 53/06; F04B 39/123

See application file for complete search history.

(56) References Cited

U.S. PATENT DOCUMENTS 5,232,349 A 8/1993 Kimura et al.
5,626,463 A 5/1997 Kimura et al.
(Continued)

FOREIGN PATENT DOCUMENTS

CN 1542273 11/2004
CN 101235808 8/2008
(Continued)

OTHER PUBLICATIONS

Office Action issued in China Counterpart Patent Appl. No. 201310526528.8, dated Aug. 17, 2015 , along with an English translation thereof.

*Primary Examiner* — Bryan Lettman
(74) *Attorney, Agent, or Firm* — Greenblum & Bernstein, P.L.C.

(57) ABSTRACT

A piston-type compressor includes a housing, a drive shaft supported on the housing, a communication hole formed inside the drive shaft, a valve mechanism, and a cylindrical body. The cylindrical body is inserted in the communication hole to disconnect a residual gas bypass passage and the communication hole from each other and to open the interior space of the cylindrical body to the communication hole. The valve mechanism includes an annular space defined outside the cylindrical body in the communication hole and multiple connection holes providing communication between the annular space and communication passages. The residual gas bypass passage is formed of the annular space and the multiple connection holes.

8 Claims, 9 Drawing Sheets

(51) Int. Cl.
*F04B 39/12* (2006.01)
*F04B 7/00* (2006.01)

(56) References Cited

U.S. PATENT DOCUMENTS

| | | | | |
|---|---|---|---|---|
| 6,558,133 | B2 | 5/2003 | Fukanuma et al. | |
| 7,241,116 | B2 * | 7/2007 | Tarutani | F04B 39/14 417/269 |
| 2003/0095876 | A1 * | 5/2003 | Tarutani | F04B 27/1018 417/269 |
| 2004/0170504 | A1 | 9/2004 | Murakami et al. | |
| 2004/0179951 | A1 * | 9/2004 | Ota | F04B 27/1018 417/269 |
| 2005/0196291 | A1 * | 9/2005 | Inoue | F04B 27/10 417/269 |
| 2006/0228229 | A1 * | 10/2006 | Inoue | F04B 27/109 417/269 |
| 2008/0193304 | A1 | 8/2008 | Kanai et al. | |
| 2008/0286125 | A1 | 11/2008 | Sugiura et al. | |
| 2013/0042750 | A1 | 2/2013 | Takahashi et al. | |
| 2015/0093263 | A1 * | 4/2015 | Kimoto | F04B 27/12 417/222.2 |

FOREIGN PATENT DOCUMENTS

| | | |
|---|---|---|
| CN | 102803727 | 11/2012 |
| JP | 5-71467 | 3/1993 |
| JP | 6-117365 | 4/1994 |
| JP | 2005-299478 | 10/2005 |
| JP | 2006-22786 | 1/2006 |
| JP | 2007-247551 | 9/2007 |
| JP | 2008-196459 | 8/2008 |

* cited by examiner

PISTON TYPE COMPRESSOR

BACKGROUND OF THE INVENTION

The present invention relates to a piston-type compressor and, in particular, to a piston-type compressor including a piston arranged to reciprocate within a cylinder bore of a cylinder block.

Reciprocating compressors of the type disclosed in, for example, Japanese Laid-Open Patent Publication No. 6-117365 have been conventionally known as a piston-type compressor. The reciprocating compressor disclosed in the above-described publication includes a cylinder block having multiple bores around the axis, a drive shaft borne in a shaft hole of the cylinder block, and multiple pistons linked with a swash plate in a crank chamber that cooperates with the drive shaft and arranged to move linearly within the corresponding bores. Communication passages are formed between the respective bores and the shaft hole to provide communication there between. The drive shaft is coupled in a synchronously rotational manner with a rotary valve. The rotary valve has a suction passage for sequentially providing communication between the communication passage of the respective bore in which a suction stroke is being executed and a suction chamber. The rotary valve includes a residual gas bypass passage. The residual gas bypass passage includes a high-pressure opening portion, a low-pressure opening portion, and a communication path. The high-pressure opening portion provides communication via the bore on discharge termination and the corresponding communication passage. The low-pressure opening portion provides communication via the bore in which compression work is substantially ongoing in synchronization with the discharge termination and the corresponding communication passage. The communication path connects the high-pressure opening portion and the low-pressure opening portion. Specifically, a residual gas bypass groove is formed as the residual gas bypass passage within a seal region opposed to the communication passage of the respective bore in which a compression and discharge stroke are being executed, on the outer peripheral surface of the rotary valve.

In the reciprocating compressor disclosed in the above-described publication, by rotating the rotary valve in synchronization with the drive shaft, refrigerant gas in the suction chamber is sequentially taken into the respective bores through the suction passage of the rotary valve and the communication passage of each bore in which a suction stroke is being executed. The operation of taking the refrigerant gas into the respective bores is then continued smoothly and stably, and therefore the pressure loss becomes significantly low.

Also, by rotating the rotary valve in synchronization with the drive shaft, residual gas within the bore on discharge termination is recovered through the high-pressure opening portion and transferred through the communication path to the low-pressure opening portion. Since the completely compressed refrigerant gas is conducted into the bore in which a compression stroke is being executed without depressurization at a suction pressure, unnecessary recompression can be reduced, the operation runs under a relatively sufficient power efficiency. Further, since the residual gas is less likely to re-expand during a suction stroke of the bore, the refrigerant gas in the suction chamber is reliably taken into the bore.

Piston-type compressors of the type disclosed in, for example, Japanese Published Laid-Open Patent Publication No. 5-71467 have been proposed as another conventional technique. In the piston-type compressor disclosed in the above-described publication, communication grooves are formed to radially provide communication between respective cylinder bores and a valve chamber in which a rotary valve is housed. The rotary valve housed in the valve chamber is coupled in a synchronously rotational manner with a drive shaft. The rotary valve is formed with a suction gas passage and a suction gas guide groove for sequentially providing communication between the communication groove of the respective cylinder bore in which a suction stroke is being executed and a suction chamber. Inside the rotary valve, a gas release hole for conducting residual gas from the cylinder bore on discharge termination to the low-pressure cylinder bore is formed in a manner penetrating in the radial direction of the rotary valve.

In the piston-type compressor disclosed in the above-described publication, with a relative rotation between the cylinder block and the rotary valve in conjunction with the reciprocation of the respective pistons, the gas release hole of the rotary valve provides communication between the compression chamber of the cylinder bore in which the discharge of compression gas has been completed and the compression chamber of the other cylinder bore in which the suction of compression gas has already been completed at the completion of discharge of the former cylinder bore. This causes high-pressure residual gas in the compression chamber of the cylinder bore in which discharge has been completed to be released into the compression chamber of the other cylinder bore in which the suction of compression gas has already been completed and thereby the pressure in the compression chamber of the cylinder bore in which discharge was completed to be reduced. Accordingly, even when the piston of the cylinder bore starts a suction stroke, the re-expansion volume of the residual gas in the compression chamber is significantly low and the gas intake into the compression chamber is swiftly started.

In the reciprocating compressor disclosed in Japanese Laid-Open Patent Publication No. 6-117365, however, since the residual gas bypass groove is formed in the outer peripheral surface of the rotary valve, refrigerant gas is likely to leak through the boundary between the cylinder block and the rotary valve. There has thus been a demand to prevent leakage of refrigerant gas more reliably. Further, the residual gas bypass groove, which is provided along the outer peripheral surface of the rotary valve, is difficult to machine and form. This may result in poor productivity. In addition, the depth of the groove is subject to dimensional constraints in consideration of various conditions such as strength.

In the piston-type compressor disclosed in Japanese Laid-Open Patent Publication No. 5-71467, since the gas release hole is formed in a manner extending through in the radial direction of the rotary valve, only one time of hole machining is required to form the gas release hole, which is easier than machining a groove in the outer peripheral surface. However, if an axial communication hole, for example, is formed at the center of the drive shaft to provide a recovery passage for recovering oil there through, it is difficult to provide a through-type gas release hole in the hollow drive shaft. Although the gas release hole may be formed around the communication hole formed in the drive shaft, not only does hole machining become troublesome involving complications such as being required multiple times, but also an advanced hole machining technique may be required.

SUMMARY OF THE INVENTION

It is an object of the present invention to provide a piston-type compressor in which multiple passages can be formed inside a drive shaft and one of the passages serves as a residual gas bypass passage for conducting high-pressure residual gas in a cylinder bore to a low-pressure cylinder bore.

To achieve the foregoing objective and in accordance with one aspect of the present invention, a piston-type compressor is provided that includes a housing having a shaft hole and a plurality of cylinder bores provided around the shaft hole, a drive shaft inserted and rotationally supported in the shaft hole, a plurality of pistons, a plurality of communication passages, a valve mechanism, a communication hole, and a cylindrical body. The pistons are inserted in the respective cylinder bores. The pistons are caused to reciprocate within the cylinder bores by rotation of the drive shaft. The communication passages provide communication between the cylinder bores and the shaft hole. The valve mechanism is arranged to operate integrally with the drive shaft in the shaft hole and includes a residual gas bypass passage in communication with the communication passages to guide high-pressure residual gas in a cylinder bore to a low-pressure cylinder bore. The communication hole is formed inside the drive shaft. The cylindrical body is inserted in the communication hole to disconnect the residual gas bypass passage and the communication hole from each other and to open the interior space of the cylindrical body to the communication hole. The valve mechanism includes an annular space defined outside the cylindrical body in the communication hole and a plurality of connection holes providing communication between the annular space and the communication passages. The residual gas bypass passage is formed of the annular space and the connection holes.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 5(*b*) is a perspective view of a cylindrical body according to the second embodiment;

FIG. 6(*b*) is a perspective view of a cylindrical body according to the third embodiment;

FIG. 7(*b*) is a perspective view of a cylindrical body according to the fourth embodiment;

FIG. 9(*b*) is a perspective view of a cylindrical body according to the fifth embodiment.

DETAILED DESCRIPTION OF THE PREFERRED EMBODIMENTS

First Embodiment

A swash plate-type variable displacement compressor will be hereinafter described with reference to the accompanying drawings as a piston-type compressor according to a first embodiment. The swash plate-type variable displacement compressor (hereinafter referred to simply as "compressor") of this embodiment is an air-conditioning compressor to be mounted on a vehicle.

Figure 1:
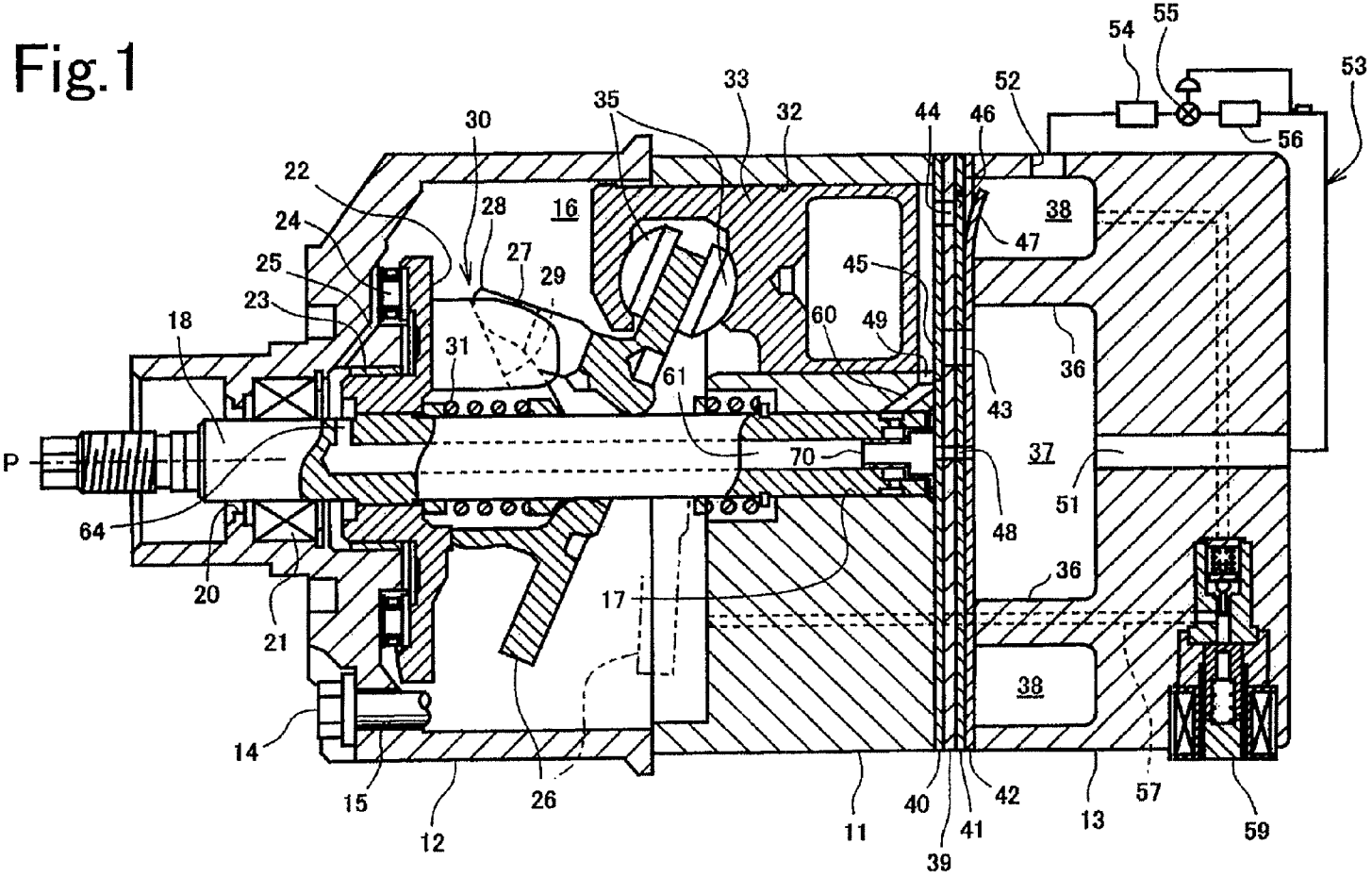
FIG. 1 is a longitudinal cross-sectional view of a piston-type compressor according to a first embodiment.

In the compressor shown in FIG. 1, a front housing member 12 joins the front end of a cylinder block 11, while a rear housing member 13 joins the rear end of the cylinder block 11. The cylinder block 11, the front housing member 12, and the rear housing member 13 are coupled to each other using multiple through bolts 14 (only one of them is shown in FIG. 1). The cylinder block 11 is formed with bolt through holes (not shown) through which the through bolts 14 are inserted, and the front housing member 12 is also formed with bolt through holes 15. The rear housing member 13 is formed with bolt holes (not shown) each having an internal thread into which the external thread portions of the respective through bolts 14 are screwed. The cylinder block 11, the front housing member 12, and the rear housing member 13 are elements constituting the entire housing of the compressor.

The front housing member 12 thus joining the cylinder block 11 forms a control pressure chamber 16 therein. A shaft hole 17 is formed in the cylinder block 11. A drive shaft 18 is inserted through the shaft hole 17 and rotationally supported in the cylinder block 11. In this embodiment, a coating layer containing lubricant is formed on the outer peripheral surface of the drive shaft 18 in sliding contact with the cylinder block 11. A shaft hole 20 is also formed in the front housing member 12 and the drive shaft 18 is inserted through the shaft hole 20. A shaft sealing device 21 is provided in the shaft hole 20. The shaft sealing device 21 employs a lip seal mainly made of rubber material. The drive shaft 18 protrudes outward from the control pressure chamber 16 to receive a rotary driving force from an external drive source such as an engine (not shown).

A rotary support 22 is fixed to the drive shaft 18. The rotary support 22 is rotationally supported on the front housing member 12 via a radial bearing 23 to be integrally rotational with the drive shaft 18. A thrust bearing 24 for receiving a load along the axis P of the drive shaft 18 is provided between the boss portion of the rotary support 22 and the inner wall surface of the front housing member 12. The front housing member 12 is formed with an oil path 25 extending from an outer peripheral area of the control pressure chamber 16 to between the front housing member 12 and the rotary support 22 to face the thrust bearing 24. The oil path 25 reaches the shaft hole 20. A swash plate 26 is supported on the rotary support 22 in a manner slidable along and tiltable with respect to the axis P of the drive shaft 18.

The rotary support 22 is provided with a pair of arms 27 protruding toward the swash plate 26 (only one of the arms 27 is shown and the other arm 27 is not shown in FIG. 1). The swash plate 26 is provided with a pair of protrusions 28 protruding toward the rotary support 22. The protrusions 28 are inserted in a recessed portion formed between the pair of arms 27 of the rotary support 22. The protrusions 28 are movable within the recessed portion being sandwiched between the pair of arms 27. A cam surface 29 is formed on the surface being the bottom of the recessed portion between the arms 27, and the distal end portions of the protrusions 28 are in sliding contact with the cam surface 29. The swash plate 26 is tiltable in the axial direction of the drive shaft 18 through the linkage between the protrusions 28 sandwiched between the pair of arms 27 and the cam surface 29 and is also integrally rotational with the drive shaft 18. The tilt of the swash plate 26 is guided by the sliding guide relationship between the cam surface 29 and the protrusions 28 and the sliding support action of the drive shaft 18. The pair of arms 27, the protrusions 28, and the cam surface 29 constitute a conversion mechanism 30 provided between the swash plate 26 and the rotary support 22. The conversion mechanism 30 couples the rotary support 22 and the swash plate 26 in a tiltable manner as well as in a manner torque-transmittable from the drive shaft 18 to the swash plate 26.

A coil spring 31 is mounted on the drive shaft 18. The coil spring 31 is positioned between the rotary support 22 and the swash plate 26. The coil spring 31 applies to the swash plate 26 an urging force for separating the swash plate 26 from the rotary support 22.

When the radial center portion of the swash plate 26 moves toward the rotary support 22, the angle of inclination of the swash plate 26 increases with respect to the radial direction of the drive shaft 18. The maximum inclination angle of the swash plate 26 is defined by the contact between the rotary support 22 and the swash plate 26. The swash plate 26 shown in FIG. 1 is at the maximum inclination angle.

As shown in FIG. 1, pistons 33 are housed in a reciprocal manner, respectively, in a plurality of cylinder bores 32 formed in the cylinder block 11. The rotational motion of the swash plate 26 is converted through a pair of shoes 35 into a forward and backward reciprocating motion of the pistons 33, and thus the pistons 33 reciprocate within the corresponding cylinder bores 32.

A partition wall 36 is formed in the rear housing member 13 and a suction chamber 37 and a discharge chamber 38 are defined by the partition wall 36. A valve plate 39, valve forming plates 40 and 41 and a retainer forming plate 42 are provided between the cylinder block 11 and the rear housing member 13. Suction ports 43 are formed in the valve plate 39, the valve forming plate 41 and the retainer forming plate 42. Discharge ports 44 are formed in the valve plate 39 and the valve forming plate 40. Suction valves 45 are formed in the valve forming plate 40, and discharge valves 46 are formed in the valve forming plate 41. Retainer 47 for limiting the degree of opening of the discharge valves 46 are formed on the retainer forming plate 42.

Figure 2:
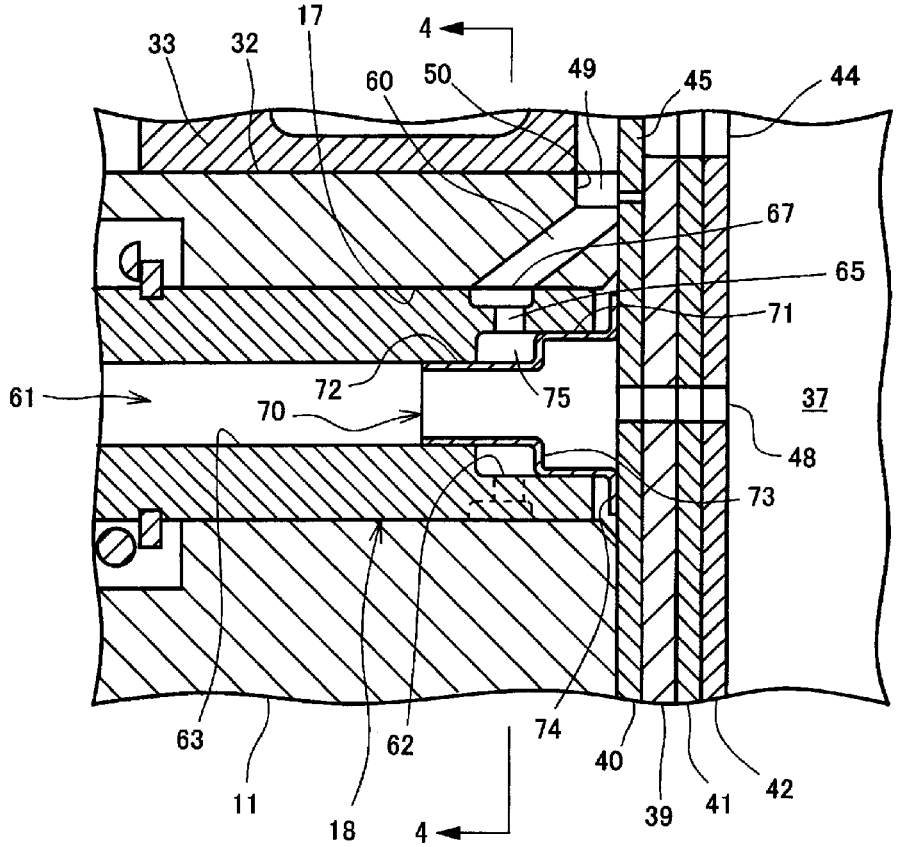
FIG. 2 is an enlarged longitudinal cross-sectional view showing a substantial part of the piston-type compressor.

A through hole 48 is formed through the center of the valve plate 39, the valve forming plates 40 and 41 and the retainer forming plate 42 to connect the shaft hole 17 and the suction chamber 37. As shown in FIG. 2, a space 49 in communication with a portion of each cylinder bore 32 near the rear housing member 13 is formed in the vicinity of the shaft hole 17 of the cylinder block 11. The degree of opening of the suction valve 45 is limited by an end surface 50 of the cylinder block 11 forming the space 49.

Refrigerant in the suction chamber 37 flows through the suction port 43 and the suction valve 45, opened with a forward movement (movement from right to left in FIG. 1) of each piston 33, into each cylinder bore 32. The gaseous refrigerant flowed into each cylinder bore 32 is discharged through the discharge port 44 and the discharge valve 46, opened with a backward movement (movement from left to right in FIG. 1) of each piston 33, into the discharge chamber 38. The degree of opening of the discharge valve 46 is limited by contacting the retainer 47 on the retainer forming plate 42.

A suction passage 51 for introducing refrigerant there through into the suction chamber 37 and a discharge passage 52 for discharging refrigerant from the discharge chamber 38 there through are connected to each other through an external refrigerant circuit 53. A heat exchanger 54 for drawing heat from refrigerant, an expansion valve 55 and a heat exchanger 56 for providing ambient heat to refrigerant are provided on the external refrigerant circuit 53. The expansion valve 55 is arranged to control the flow rate of refrigerant according to the change in the temperature of refrigerant gas at the outlet of the heat exchanger 56.

The refrigerant gas discharged into the discharge chamber 38 flows through the discharge passage 52 into the external refrigerant circuit 53. The refrigerant gas flowed into the external refrigerant circuit 53 flows through the suction passage 51 back into the suction chamber 37. The discharge chamber 38 and the control pressure chamber 16 are in communication with each other through a supply passage 57. A displacement control valve 59 is provided in the rear housing member 13 to control the flow rate of refrigerant gas flowing through the supply passage 57.

When the flow rate of refrigerant gas flowing through the supply passage 57 increases with an increase in the degree of opening of the displacement control valve 59, the pressure in the control pressure chamber 16 also increases. This reduces the inclination angle of the swash plate 26. When the flow rate of refrigerant gas flowing through the supply passage 57 decreases with a reduction in the degree of opening of the displacement control valve 59, the pressure in the control pressure chamber 16 also decreases. This increases the inclination angle of the swash plate 26.

Figure 4:
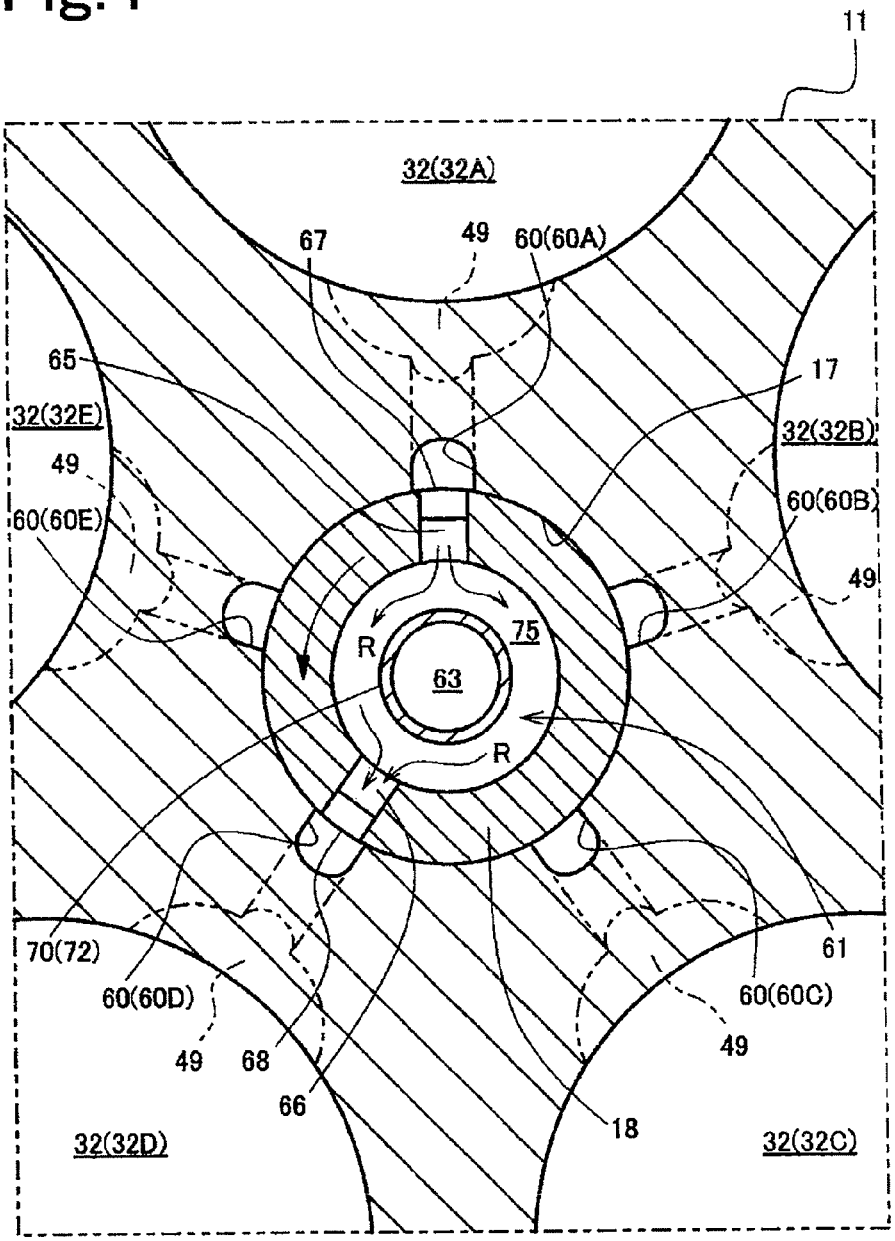
FIG. 4 is a fragmentary view taken in the direction of arrows 4-4 in FIG. 2.

Meanwhile, the compressor of this embodiment includes a residual gas bypass passage for conducting high-pressure refrigerant gas remaining in the cylinder bore 32 (hereinafter referred to as "high-pressure residual gas") to a low-pressure cylinder bore 32. As shown in FIG. 4, the cylinder block 11 has communication passages 60 (distinguished as communication passages 60A to 60E in FIG. 4, and the pistons 33 are omitted in FIG. 4). The communication passages 60 allow the spaces 49 provided in the respective cylinder bores 32 and the shaft hole 17 to communicate with each other. The communication passages 60 are thus elements connecting the cylinder bores 32 and the shaft hole 17. The number of the communication passages 60 corresponds to the number of the cylinder bores 32, and the multiple communication passages 60 are arranged radially in the cylinder block 11. As shown in FIGS. 1 and 2, the communication passages 60 are inclined toward the axis with respect to the radial direction of the drive shaft 18. The openings of the communication passages 60 near the spaces 49 are positioned in the vicinity of the rear housing member 13. In contrast, the openings of the communication passages 60 near the shaft hole 17 are positioned closer to the control pressure chamber 16 than the openings of the communication passages 60 near the spaces 49.

On the other hand, the drive shaft 18 is formed with an axially extending communication hole 61 centering on the axis P. The communication hole 61 inside the drive shaft 18 extends from one end of the drive shaft 18 near the rear housing member 13 towards the front housing member 12. As shown in FIG. 2, the communication hole 61 inside the drive shaft 18 includes a large diameter hole portion 62 and a small diameter hole portion 63. The large diameter hole portion 62 extends from the rear end (one end) towards the front end (the other end) of the drive shaft 18 and has a large inner diameter. The small diameter hole portion 63 extends from the large diameter hole portion 62 towards the front housing member 12 and has an inner diameter smaller than that of the large diameter hole portion 62.

The front end portion of the small diameter hole portion 63 reaches between the shaft sealing device 21 and the rotary support 22 in the axial direction of the drive shaft 18 in the shaft hole 20. As shown in FIG. 1, a hole 64 is formed in the radial direction from the front end portion of the small diameter hole portion 63 to the outer periphery of the drive shaft 18. The hole 64 is in communication with the oil path 25 via the shaft hole 20. Accordingly, the control pressure chamber 16 and the suction chamber 37 are in communication with each other through the through hole 48, the communication hole 61 and the hole 64. Refrigerant gas in the control pressure chamber 16 flows via the through hole 48, the communication hole 61 and the hole 64 into the suction chamber 37. The through hole 48 and the communication hole 61 and the hole 64 of the drive shaft 18 thus serve not only as an oil flow passage but also as a bleed passage. That is, the through hole 48, the communication hole 61, and the hole 64 are elements that control the pressure in the control pressure chamber 16 in cooperation with the displacement control valve 59 and the supply passage 57.

Figure 3:
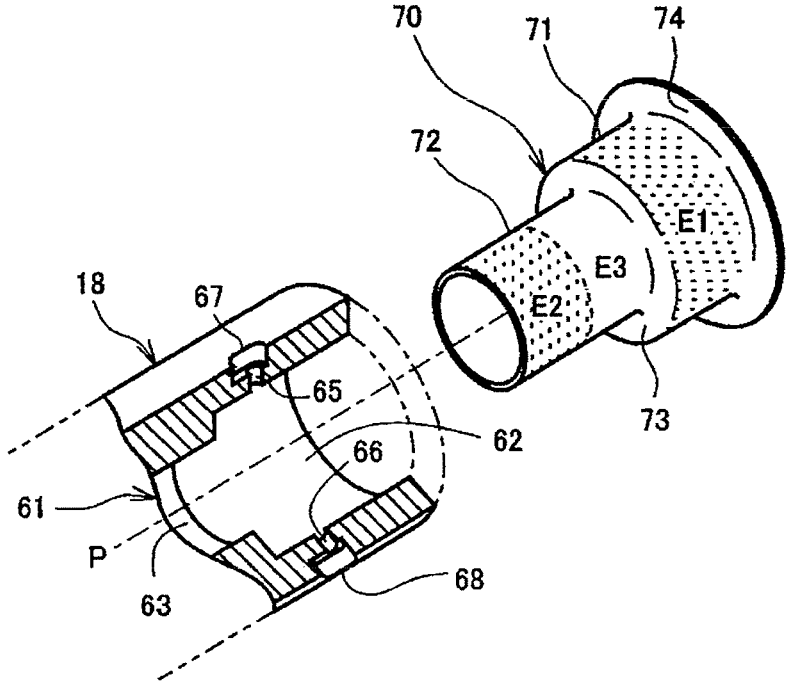
FIG. 3 is a perspective view of a cylindrical body according to the first embodiment.

As shown in FIGS. 2 to 4, the drive shaft 18 is formed with a high-pressure connection hole 65 and a low-pressure connection hole 66. The connection holes 65, 66 radially extend from the large diameter hole portion 62 to the outer periphery of the drive shaft 18. The high-pressure connection hole 65 and the low-pressure connection hole 66 are formed at positions communicating with the communication passages 60 of the cylinder bores 32 during the operation of the compressor.

As shown in FIG. 3, in this embodiment, the relationship is made in which, when the high-pressure connection hole 65 is in communication with the communication passage 60 (60A) of the cylinder bore 32, the low-pressure connection hole 66 is in communication with the communication passage 60 (60D) of the cylinder bore 32. The opening of the high-pressure connection hole 65 near the communication passage 60 is a high-pressure opening portion 67, and the opening of the low-pressure connection hole 66 near the communication passage 60 is a low-pressure opening portion 68. Since the openings of the communication passages 60 near the shaft hole 17 are formed in an elliptical shape, the high-pressure opening portion 67 and the low-pressure opening portion 68 are formed in an elongated circular shape similar to that of the openings of the communication passages 60 near the shaft hole 17.

A cylindrical body 70 is press-fitted from the communication hole 61 of the drive shaft 18 through the rear end thereof. The cylindrical body 70 of this embodiment is a shaft stopper for limiting the movement of the drive shaft 18 toward the rear housing member 13, that is, the rearward movement. The cylindrical body 70 of this embodiment includes a large diameter cylindrical portion 71 and a small diameter cylindrical portion 72. The large diameter cylindrical portion 71 has an outside diameter dimension press-fittable into the large diameter hole portion 62 of the communication hole 61. The small diameter cylindrical portion 72 has an outside diameter dimension press-fittable into the small diameter hole portion 63. A radially extending annular connecting portion 73 is formed between the large diameter cylindrical portion 71 and the small diameter cylindrical portion 72. A radially extending annular portion 74 is formed at one end portion of the large diameter cylindrical portion 71. Accordingly, the large diameter cylindrical portion 71 is fittable to the drive shaft 18 at the large diameter hole portion 62. Also, the small diameter cylindrical portion 72 is fittable to the drive shaft 18 at the small diameter hole portion 63.

The portion of the large diameter cylindrical portion 71 fixed to the drive shaft 18 by press-fitting is a trailing fitting portion E1 (hatched in FIG. 3) on the trailing side in the insertion direction of the cylindrical body 70. The portion of the small diameter cylindrical portion 72 fixed to the drive shaft 18 by press-fitting is a leading fitting portion E2 (hatched in FIG. 3) on the leading side in the insertion direction of the cylindrical body 70. The trailing fitting portion E1 and the leading fitting portion E2 of the cylindrical body 70 provide a function of fixing the cylindrical body 70 to the drive shaft 18 as well as a sealing function for preventing leakage of refrigerant gas.

As the cylindrical body 70 is press-fitted into the communication hole 61 of the drive shaft 18, an annular space 75 concentric with the cylindrical body 70 is defined on the outer periphery side of the portion of the small diameter cylindrical portion 72 excluding the leading fitting portion. The portion of the small diameter cylindrical portion 72 excluding the leading fitting portion E2 is the portion which faces the large diameter hole portion 62, that is, corresponds to a space-facing portion E3 opposed to the annular space 75. The interior space of the cylindrical body 70 in communication with the small diameter hole portion 63 corresponds to a center space. Also, in this embodiment, the trailing fitting portion E1 occupies most of the large diameter cylindrical portion 71. The annular space 75 which extends around an entire circumference of the cylindrical body 70, is formed between the trailing fitting portion E1 and the leading fitting portion E2 in the axial direction of the large diameter hole portion 62 so as to be an approximately enclosed space outside the center space.

The annular space 75 and the high-pressure connection hole 65 are in communication with each other. The annular space 75 and the low-pressure connection hole 66 are also in communication with each other. That is, the high-pressure opening portion 67 and the annular space 75 are brought into communication with each other by the high-pressure connection hole 65. Also, the low-pressure opening portion 68 and the annular space 75 are brought into communication with each other by the low-pressure connection hole 66. The high-pressure connection hole 65 and the low-pressure connection hole 66 thus correspond to a plurality of connection holes providing communication between the annular space 75 and the communication passages 60. The annular space 75, together with the high-pressure connection hole 65 and the low-pressure connection hole 66, forms a residual gas bypass passage for guiding residual gas in the cylinder bore 32 on discharge termination to the cylinder bore 32 in which a compression stroke is being executed via the communication passages 60. The compressor of this embodiment includes a valve mechanism including the residual gas bypass passage and arranged to be operated integrally with the drive shaft 18 in the shaft hole 17. The valve mechanism includes the annular space 75 in the communication hole 61 defined outside the cylindrical body 70, the high-pressure connection hole 65, and the low-pressure connection hole 66. The valve mechanism is arranged to provide or block communication between the residual gas bypass passage and the communication passages 60 with the rotation of the drive shaft 18.

As the cylindrical body 70 is press-fitted into the drive shaft 18, the communication hole 61 of the drive shaft 18 is divided into the small diameter hole portion 63 in communication with the interior space of the cylindrical body 70 and the annular space 75, and the small diameter hole portion 63 and the annular space 75 are not in communication with each other. That is, the cylindrical body 70 disconnects the residual gas bypass passage and the communication hole 61 from each other as well as opens the interior space of the cylindrical body 70 to the communication hole 61. In the state where the cylindrical body 70 is fitted into the communication hole 61 and fixed to the drive shaft 18, the annular portion 74 is in contact with the valve forming plate 40. The cylindrical body 70 limits the rearward movement of the drive shaft 18 and thus serves as a shaft stopper.

Next will be described the action of the compressor of this embodiment. During the operation of the compressor, refrigerant gas is introduced from the external refrigerant circuit 53 through the suction passage 51 into the suction chamber 37. In a suction stroke, the suction valve 45 is opened. At this time, the refrigerant gas in the suction chamber 37 is introduced through the suction port 43 into the cylinder bores 32 when the suction valve 45 is opened. In this suction stroke, with a reduction in the pressure in the cylinder bores 32 and high pressure in the pressure in the discharge chamber 38, the discharge valve 46 is in close contact with the valve plate 39 without being inflected to close the discharge port 44. In the subsequent compression stroke in which the pistons 33 move from the bottom dead center position to the top dead center position, the pressure in the cylinder bores 32 increases to compress refrigerant gas therein.

In the compression stroke, the pressure in the cylinder bores 32 increases. In a discharge stroke, the discharge valve 46 is inflected to open the discharge port 44 and the refrigerant gas in the cylinder bores 32 is discharged through the discharge port 44 into the discharge chamber 38. At the same time, with an increase in the pressure in the cylinder bores 32 and low pressure in the pressure in the suction chamber 37, the suction valve 45 is in close contact with the valve plate 39 to close the suction port 43. When the pistons 33 come to the top dead center position and the refrigerant gas is discharged from the cylinder bores 32 into the discharge chamber 38 to result in a reduction in the pressure in the cylinder bores 32, the discharge valve 46 restores its original state with an elastic restoring force accumulated in the inflected discharge valve 46 and moves away from the retainer 47 to close the discharge port 44. The refrigerant gas discharged from the cylinder bores 32 into the discharge chamber 38 is then carried through the discharge passage 52 into the external refrigerant circuit 53.

Meanwhile, when the drive shaft 18 rotates during the operation of the compressor, the swash plate 26 also rotates together with the drive shaft 18. With the rotation of the swash plate 26, the respective pistons 33 reciprocate within the corresponding cylinder bores 32. By the movement of the pistons 33 from the top dead center to the bottom dead center within the cylinder bores 32, a suction stroke is executed in the cylinder bores 32. By the movement of the pistons 33 from the bottom dead center to the top dead center within the cylinder bores 32, a compression and discharge stroke is executed in the cylinder bores 32.

In the state shown in FIG. 4, for example, the cylinder bore 32 (32A) is in a state immediately after the completion of a discharge stroke. In this state, a compression stroke is being executed in the cylinder bores 32 (32B and 32C). The cylinder bore 32 (32D) is in a state immediately after the completion of a suction stroke. In this state, a suction stroke is being executed in the cylinder bore 32 (32E).

In the state shown in FIG. 4, the valve mechanism provides communication between the high-pressure connection hole 65 of the drive shaft 18 and the communication passage 60 (60A) in communication with the high-pressure cylinder bore 32 (32A). At this time, the low-pressure connection hole 66 of the drive shaft 18 is in communication with the communication passage 60 (60D) in communication with the low-pressure cylinder bore 32 (32D). As a result, high-pressure residual gas in the cylinder bore 32 (32A) is introduced through the communication passage 60 (60A) into the annular space 75, and then introduced from the annular space 75 through the low-pressure connection hole 66 and further the communication passage 60 (60D) into the cylinder bore 32 (32D). Arrows R indicate the flow of refrigerant gas in FIG. 4. The outer peripheral surface of the drive shaft 18 between the high-pressure opening portion 67 (and the low-pressure opening portion 68) and the control pressure chamber 16 in the axial direction of the drive shaft 18 is entirely in sliding contact with the cylinder block 11 to provide a sealing function for minimizing leakage of refrigerant gas from the shaft hole 17. The outer peripheral surface of the drive shaft 18 between the high-pressure opening portion 67 (and the low-pressure opening portion 68) and the rear end of the drive shaft 18 in the axial direction of the drive shaft 18 is also in sliding contact with the cylinder block 11 to provide a sealing function for minimizing leakage of refrigerant gas from the shaft hole 17.

Since the high-pressure residual gas in the high-pressure cylinder bore 32 (32A) is introduced into the low-pressure cylinder bore 32 (32D), the pressure in the cylinder bore 32 (32A) decreases to near the suction pressure. The pressure in the cylinder bore 32 (32D), into which the high-pressure residual gas is introduced from the cylinder bore 32 (32A), increases to slightly higher than the suction pressure.

Thereafter, in a state where the drive shaft 18 rotates in the direction indicated by an arrow in FIG. 4 and the valve mechanism provides communication neither between the high-pressure connection hole 65 and the communication passage 60 (60A) nor between the low-pressure connection hole 66 and the cylinder bore 32 (32D), a suction stroke is being executed in the cylinder bore 32 (32A) and a compression stroke is being executed in the cylinder bore 32 (32D). When the drive shaft 18 further rotates, the valve mechanism provides communication between the high-pressure connection hole 65 and the communication passage 60 (60E) as well as between the low-pressure connection hole 66 and the cylinder bore 32 (32C). At this time, the high-pressure residual gas in the cylinder bore 32 (32E) is introduced through the communication passage 60 (60E) into the annular space 75, and then introduced from the annular space 75 through the low-pressure connection hole 66 and further the communication passage 60 (60C) into the cylinder bore 32 (32C).

Meanwhile, during the operation of the compressor, oil in the control pressure chamber 16 lubricates sliding portions such as the radial bearing and the thrust bearing 24. For example, oil that lubricated the thrust bearing 24 flows through the oil path 25 and cools the shaft sealing device 21 in the shaft hole 20. Further, the oil flows through the hole 64 and the small diameter hole portion 63 of the communication hole 61, and then passes through the interior of the cylindrical body 70 to be introduced into the suction chamber through the through hole 48.

This embodiment achieves the following advantages.

(1) The high-pressure connection hole 65, the annular space 75 and the low-pressure connection hole 66 formed in the drive shaft 18 forms a residual gas bypass passage for conducting high-pressure residual gas in the high-pressure cylinder bore 32 to the low-pressure cylinder bore 32, and the valve mechanism provides communication between the residual gas bypass passage and the communication passages 60 in the shaft hole 17. As the cylindrical body 70 is press-fitted into the communication hole 61, the space of the communication hole 61 partially forms the annular space 75, which is a part of the residual gas bypass passage. In addition, the small diameter hole portion 63, which is on the center side of the annular space 75, can serve as a passage other than the residual gas bypass passage, such as an oil passage or a passage for controlling refrigerant gas in the control pressure chamber 16. Further, the high-pressure connection hole 65 and the low-pressure connection hole 66 can be formed with simple machining.

(2) Since the trailing fitting portion E1 and the leading fitting portion E2 provide press-fitting, the cylindrical body 70 can be fixed in the drive shaft 18. Fixing the cylindrical body 70 in the drive shaft 18 allows the annular space 75 to be formed. The trailing fitting portion E1 and the leading fitting portion E2 of the cylindrical body 70 can provide a sealing function for minimizing leakage of refrigerant gas.

(3) The communication hole 61 includes the large diameter hole portion 62 extending from the rear end (a first end) towards the front end (a second end) of the drive shaft 18 and having a large inner diameter and the small diameter hole portion 63 extending from the large diameter hole portion 62 towards the second end and having an inner diameter smaller than that of the large diameter hole portion 62. Hence, no advanced machining technique is required to machine and form the communication hole 61, whereby the productivity can be improved. The cylindrical body 70 can also be produced easily because it is only required to form the small diameter cylindrical portion 72 fittable into the small diameter hole portion 63 of the drive shaft 18 and the large diameter cylindrical portion 71 fittable into the large diameter hole portion 62 of the drive shaft 18.

(4) Since the annular space 75, which is a part of the residual gas bypass passage, is formed inside the drive shaft 18, the sliding contact area between the drive shaft 18 and the cylinder block 11 can be made large, whereby a structure is achieved in which leakage of refrigerant gas from the shaft hole 17 can easily be minimized.

(5) The cylindrical body 70 serves as a shaft stopper for limiting the axial movement of the drive shaft 18. Using the cylindrical body 70 as a shaft stopper allows the annular space 75, which is a part of the residual gas bypass passage, to be formed with no increase in the number of parts. As a result, the production cost of the compressor can be reduced.

(6) Since the annular space 75 can be enlarged by extending the large diameter hole portion 62 in the axial direction, the degree of freedom of setting the annular space 75 becomes higher than in the case of forming a communication groove in the outer peripheral surface of the drive shaft 18. As a result, the annular space 75 can be appropriately formed in accordance with conditions required for the compressor.

(7) In the annular space 75, which is a part of the residual gas bypass passage, high-pressure residual gas can come around the small diameter cylindrical portion 72 of the cylindrical body 70 in two directions, whereby the pressure loss of refrigerant gas in the residual gas bypass passage can be reduced. Further, since the annular space 75 formed in the drive shaft 18 is thus provided as a part of the residual gas bypass passage, the drive shaft 18 can maintain a stable balance during rotation even when the annular space 75 is provided.

(8) The coating layer containing lubricant is formed on the outer peripheral surface of the drive shaft 18, which is in sliding contact with the cylinder block 11. When the drive shaft 18 is supported on a bearing, a clearance including the thickness of the bearing forms between the drive shaft 18 and the cylinder block. If the clearance is large, refrigerant gas may leak via the shaft hole 17 between the communication passages 60 and the high-pressure connection hole 65 as well as between the low-pressure connection hole 66 and the communication passages 60. It is therefore necessary to machine the cylinder block 11 into, for example, a stepped shape so that the clearance between the drive shaft 18 and the cylinder block 11 is small. Since the coating layer is thus formed on the outer peripheral surface of the drive shaft 18, the clearance between the drive shaft 18 and the cylinder block 11 can be made small and controlled more appropriately while rotationally supporting the drive shaft 18.

Second Embodiment

Next will be described a compressor according to a second embodiment. The compressor of this embodiment is also an air-conditioning compressor to be mounted on a vehicle. However, the arrangement of the cylindrical body is different from that in the foregoing embodiment. For components common to the first embodiment, the descriptions in the first embodiment will be incorporated to use the common reference numerals.

Figure 5A:
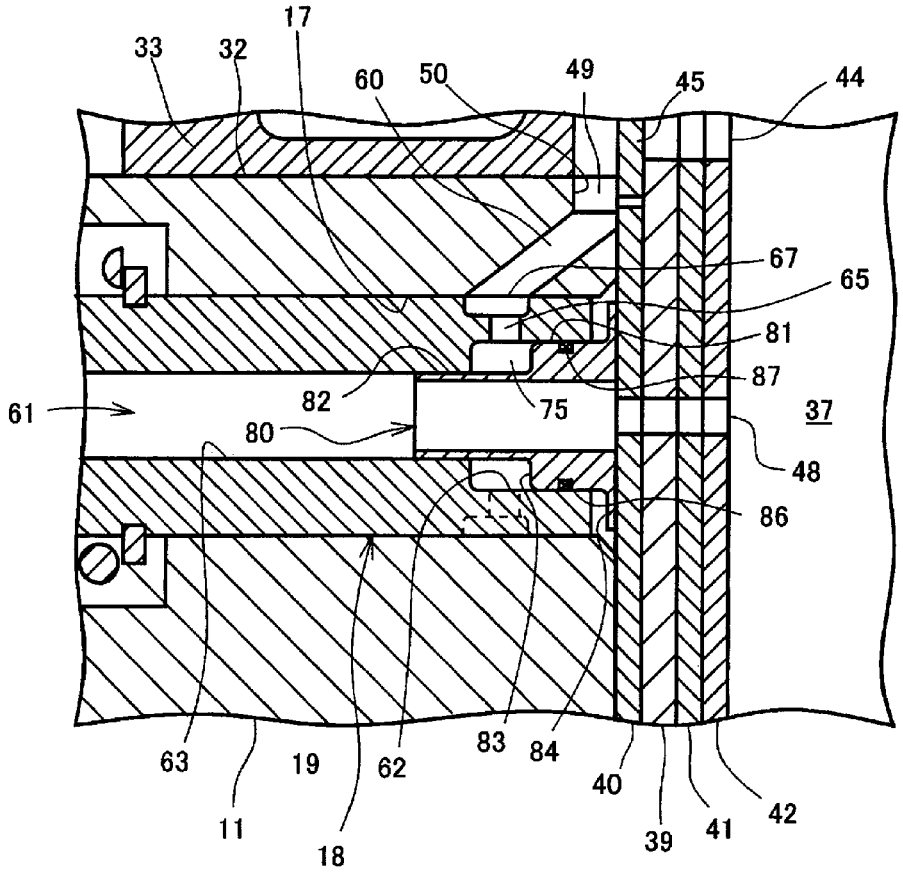
FIG. 5(*a*) is an enlarged longitudinal cross-sectional view showing a substantial part of a compressor according to a second embodiment.
Figure 5B:
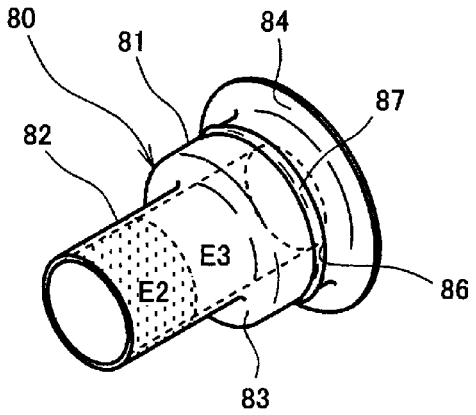

In the compressor of this embodiment, a cylindrical body 80 shown in FIGS. 5(*a*) and 5(*b*) is fixed by press-fitting to the drive shaft 18. The cylindrical body 80 of this embodiment is a shaft stopper for limiting the rearward movement of the drive shaft 18. The cylindrical body 80 of this embodiment includes a large diameter cylindrical portion 81 having an outside diameter dimension insertable into the large diameter hole portion 62 of the communication hole 61 and a small diameter cylindrical portion 82 having an outside diameter dimension press-fittable into the small diameter hole portion 63. A radially extending annular connecting portion 83 is formed between the large diameter cylindrical portion 81 and the small diameter cylindrical portion 82. A radially extending annular portion 84 is formed at one end portion of the large diameter cylindrical portion 81. The interior hole (space) of the cylindrical body 80 is set to be a diameter smaller than the outside diameter of the small diameter cylindrical portion 82. Accordingly, the large diameter cylindrical portion 81 is insertable into the large diameter hole portion 62 and the small diameter cylindrical portion 82 is press-fittable to the drive shaft 18 at the small diameter hole portion 63. The interior space of the cylindrical body 80 corresponds to a center space.

An annular groove 86 is formed in the entire outer periphery of the large diameter cylindrical portion 81, and a sealing member 87 is fitted in the annular groove 86 as a sealing portion. The sealing member 87 of this embodiment is an O-ring made of elastic rubber material. With the cylindrical body 80 being fixed to the drive shaft 18, the sealing member 87 prevents refrigerant gas from leaking from the annular space 75 through the large diameter hole portion 62.

The leading fitting portion E2 within the small diameter cylindrical portion 82 of the cylindrical body 80 is fixed by press-fitting to the drive shaft 18 to provide a function of fixing the cylindrical body 80 to the drive shaft 18 as well as a sealing function for preventing leakage of refrigerant gas. The space-facing portion E3 within the small diameter cylindrical portion 82 of the cylindrical body 80, that is, the portion of the small diameter hole portion 63 excluding the leading fitting portion E2 faces the large diameter hole portion 62.

This embodiment achieves the same advantages as (1) and (4) to (8) in the first embodiment. Moreover, since the cylindrical body 80 is arranged such that only the leading fitting portion E2 within the small diameter cylindrical portion 82 is provided as a portion that is to be press-fitted into the drive shaft 18 and the sealing member is provided in the large diameter cylindrical portion 81, the variation in the press-fitting load among the multiple press-fitting portions can be eliminated. As a result, the cylindrical body 80 can be produced more easily than in the first embodiment. Further, since the sealing member 87 is used, leakage of refrigerant gas from the annular space 75 through the large diameter hole portion 62 is reliably prevented.

As a modification of the second embodiment, the annular groove 86 may be omitted from the outer peripheral surface of the large diameter cylindrical portion 81 of the cylindrical body 80, but a thin rubber coating portion formed over the outer peripheral surface of the large diameter cylindrical portion 81 may be provided instead as a sealing portion. In this case, the rubber coating portion of the cylindrical body 80 is in close contact with the drive shaft 18 at the large diameter hole portion 62 of the communication hole 61, whereby leakage of refrigerant gas from the annular space 75 through the large diameter hole portion 62 is reliably prevented. Instead of forming such a rubber coating portion, a liquid gasket made of fluidic material such as silicone rubber may be used as a sealing portion. Also in the cylindrical body 70 of the first embodiment, a rubber coating portion may be formed on the large diameter cylindrical portion 71 or a liquid gasket may be applied.

Third Embodiment

Next will be described a compressor according to a third embodiment. The compressor of this embodiment is also an air-conditioning compressor to be mounted on a vehicle. However, the arrangement of the cylindrical body is mainly different from that in the foregoing embodiments. For components common to the first embodiment, the descriptions in the first embodiment will be incorporated to use the common reference numerals.

Figure 6A:
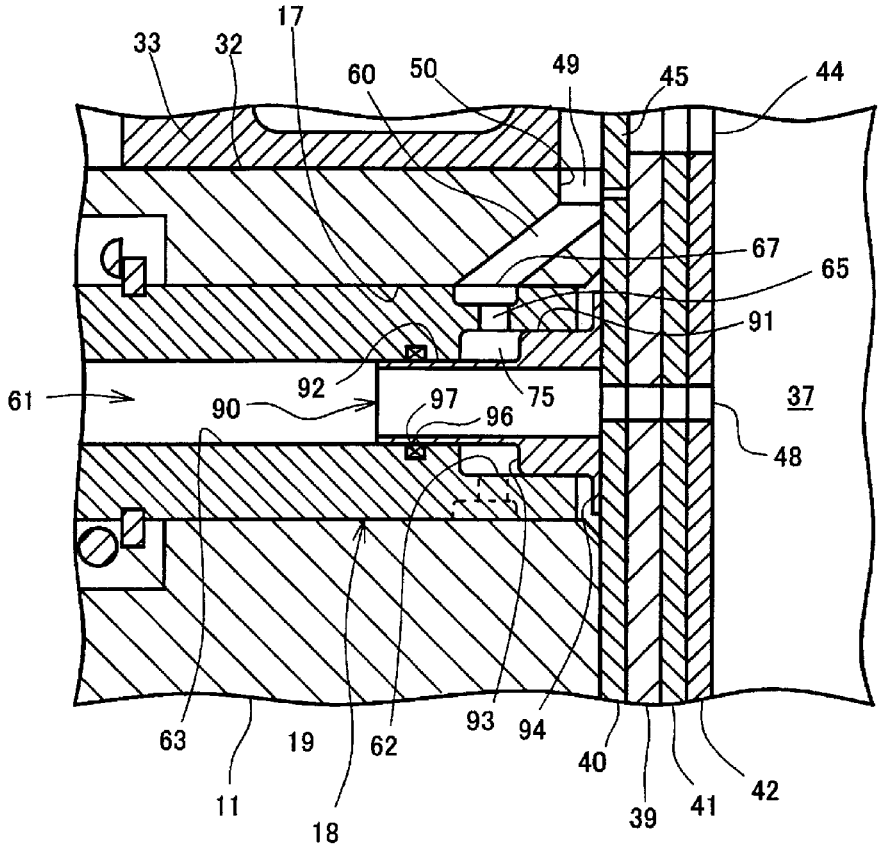
FIG. 6(*a*) is an enlarged longitudinal cross-sectional view showing a substantial part of a compressor according to a third embodiment.
Figure 6B:
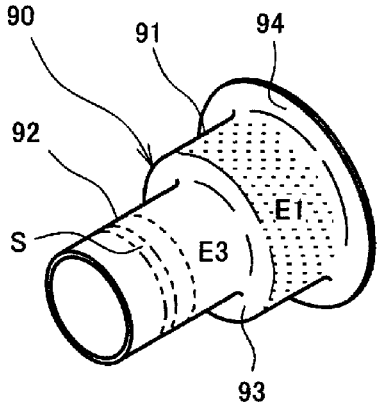

In the compressor of this embodiment, a cylindrical body 90 shown in FIGS. 6(*a*) and 6(*b*) is fixed by press-fitting to the drive shaft 18. The cylindrical body 90 of this embodiment is a shaft stopper for limiting the rearward movement of the drive shaft 18. The cylindrical body 90 of this embodiment includes a large diameter cylindrical portion 91 having an outside diameter dimension press-fittable into the large diameter hole portion 62 of the communication hole 61 and a small diameter cylindrical portion 92 having an outside diameter dimension insertable into the small diameter hole portion 63. A radially extending annular connecting portion 93 is formed between the large diameter cylindrical portion 91 and the small diameter cylindrical portion 92. A radially extending annular portion 94 is formed at one end portion of the large diameter cylindrical portion 91. The large diameter cylindrical portion 91 is press-fittable to the drive shaft 18 at the large diameter hole portion 62 and the small diameter cylindrical portion 92 is insertable into the small diameter hole portion 63. The interior hole of the cylindrical body 90 has a diameter which is set to be smaller than the outside diameter of the small diameter cylindrical portion 92. The interior space of the cylindrical body 90 corresponds to a center space.

In this embodiment, with the cylindrical body 90 being fixed to the drive shaft 18, the drive shaft 18, which forms the inner wall of the small diameter hole portion 63, is formed with an annular groove 96 on the entire periphery of the small diameter hole portion 63, and a sealing member 97 is fitted in the annular groove 96 as a sealing portion. The sealing member 97 of this embodiment is an O-ring made of elastic rubber material. With the cylindrical body 90 being fixed to the drive shaft 18, the sealing member 97 prevents refrigerant gas from leaking from the annular space 75 through the small diameter hole portion 63. The sealing member 97 is in close contact with the portion S of the cylindrical body 90 shown in FIG. 6(*b*).

This embodiment achieves the same advantages as (1) and (4) to (8) in the first embodiment. Moreover, since the cylindrical body 90 is arranged such that only the trailing fitting portion E1 within the large diameter cylindrical portion 91 is provided as a portion that is to be press-fitted into the drive shaft 18 and there is no need to provide an annular groove in the small diameter cylindrical portion 92, the cylindrical body 90 can be produced more easily than in the second embodiment. Further, since the sealing member 97 is fitted in the drive shaft 18, which forms the inner wall of the small diameter hole portion 63, leakage of refrigerant gas from the annular space 75 through the large diameter hole portion 62 can be reliably prevented.

Fourth Embodiment

Next will be described a compressor according to a fourth embodiment. The compressor of this embodiment is also an air-conditioning compressor to be mounted on a vehicle. However, the arrangement of the cylindrical body is different from that in the first embodiment. For components common to the first embodiment, the descriptions in the first embodiment will be incorporated to use the common reference numerals.

Figure 7A:
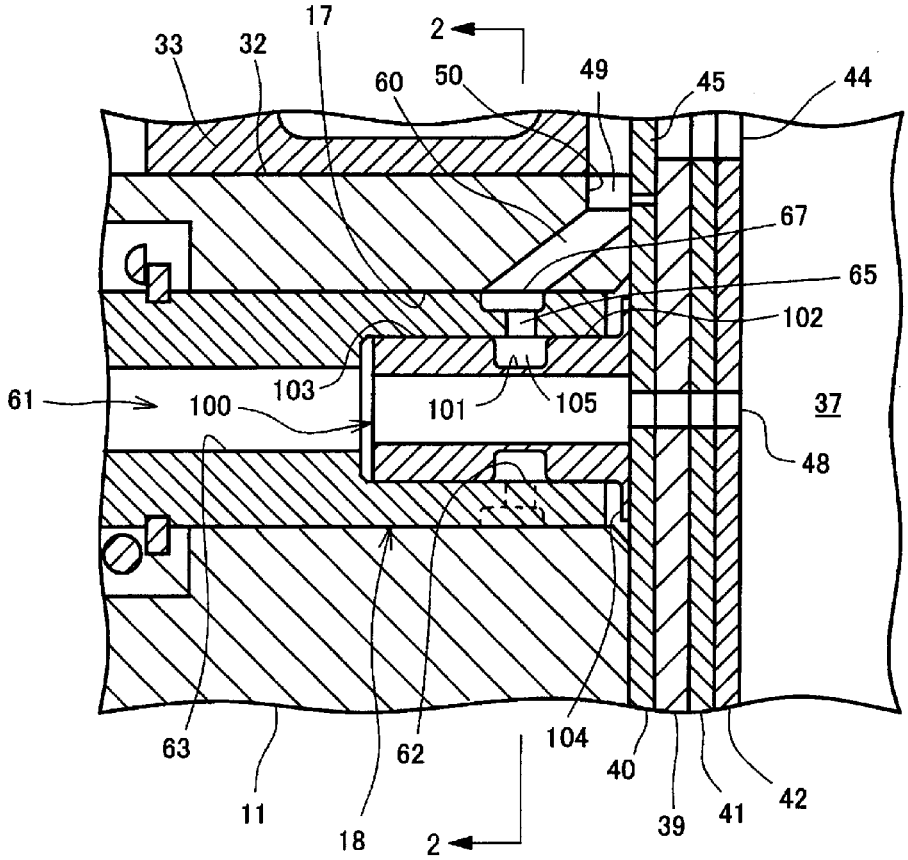
FIG. 7(*a*) is an enlarged longitudinal cross-sectional view showing a substantial part of a compressor according to a fourth embodiment.
Figure 7B:
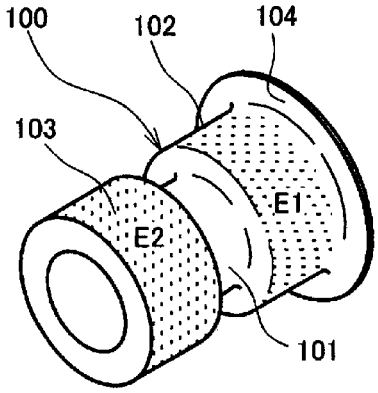

In the compressor of this embodiment, the large diameter hole portion 62 of the communication hole 61 is set to be enlarged in the axial direction relative to the large diameter hole portion 62 of the first embodiment as shown in FIGS. 7(*a*) and 7(*b*). A cylindrical body 100 of this embodiment is a shaft stopper for limiting the rearward movement of the drive shaft 18 and has an outside diameter dimension press-fittable into the large diameter hole portion 62 of the communication hole 61.

The cylindrical body 100 includes an annular recessed portion 101 formed in the entire outer periphery thereof. The cylindrical body 100 includes a rear cylindrical portion 102 having an outside diameter dimension insertable into the large diameter hole portion 62 posterior to the annular recessed portion 101 in the axial direction. The cylindrical body 100 also includes a front cylindrical portion 103 press-fittable into the large diameter hole portion 62 anterior to the annular recessed portion 101 in the axial direction of press-fitting. That is, the cylindrical body 100 is formed with the rear cylindrical portion 102 and the front cylindrical portion 103 having the same outside diameter with the annular recessed portion 101 there between. The outer peripheral surface of the rear cylindrical portion 102 forms the trailing fitting portion E1, while the outer peripheral surface of the front cylindrical portion 103 mostly forms the leading fitting portion E2. A radially extending annular portion 104 is formed at one end portion of the rear cylindrical portion 102.

In this embodiment, the cylindrical body 100 is fixed by press-fitting to the drive shaft 18 to form an annular space 105 between the annular recessed portion 101 and the inner wall of the drive shaft 18 forming the large diameter hole portion 62. The annular space 105 corresponds to the annular space 75 of the first embodiment.

This embodiment achieves the same advantages as (1) and (4) to (8) in the first embodiment. Moreover, two portions of the cylindrical body 100, that is, the rear cylindrical portion 102 and the front cylindrical portion 103 are the portions to be press-fitted into the drive shaft 18 and the rear cylindrical portion 102 and the front cylindrical portion 103 have the same diameter, whereby the cylindrical body 100 can be produced easily.

Fifth Embodiment

Next will be described a compressor according to a fifth embodiment. The compressor of this embodiment is also an air-conditioning compressor to be mounted on a vehicle.

However, the arrangement of the cylindrical body is mainly different from that in the first embodiment. Another difference from the first embodiment is that a radial bearing supporting the drive shaft is provided. For components common to the first embodiment, the descriptions in the first embodiment will be incorporated to use the common reference numerals.

Figure 8:
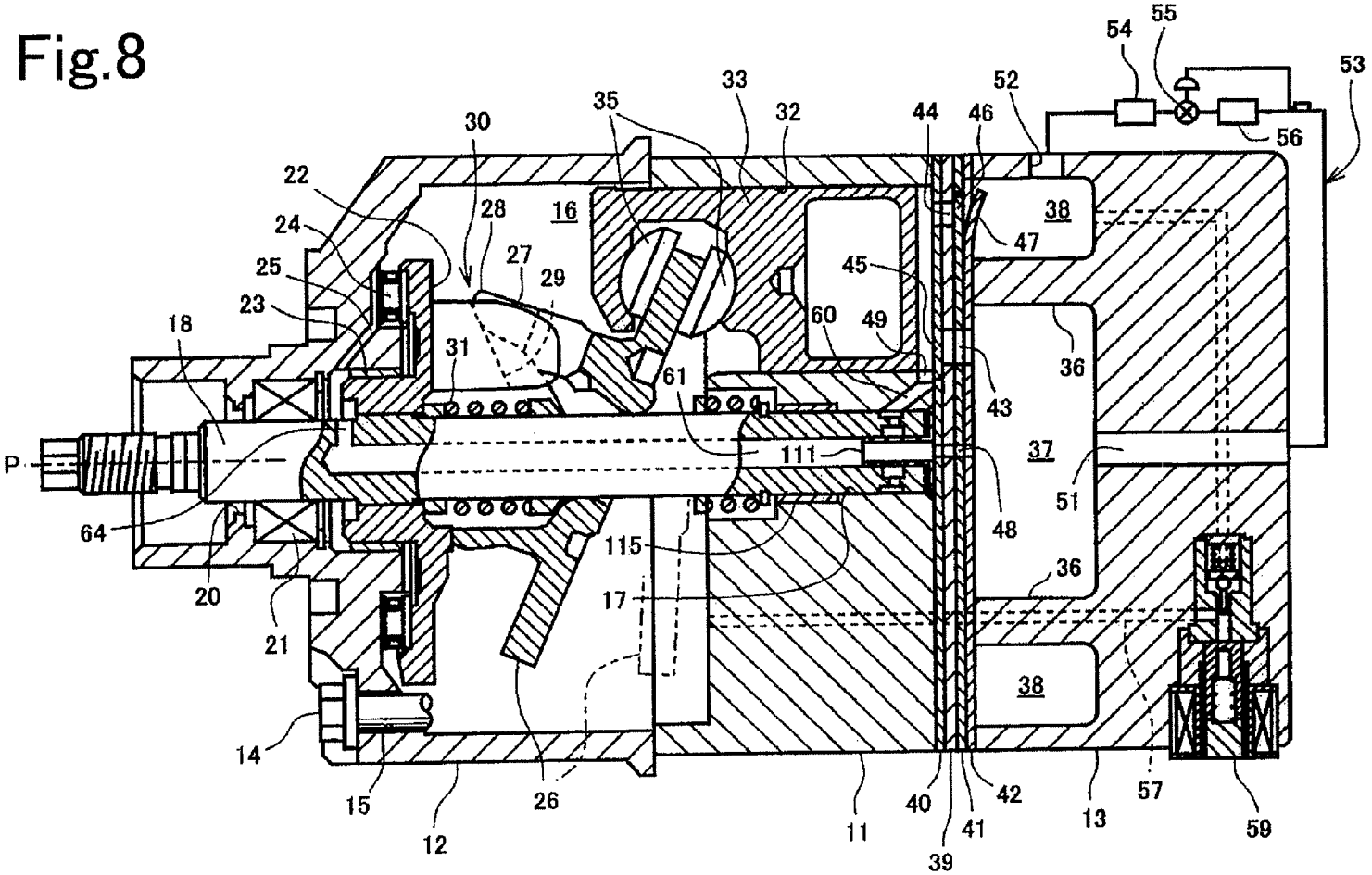
FIG. 8 is a longitudinal cross-sectional view of a piston-type compressor according to a fifth embodiment.
Figure 9A:
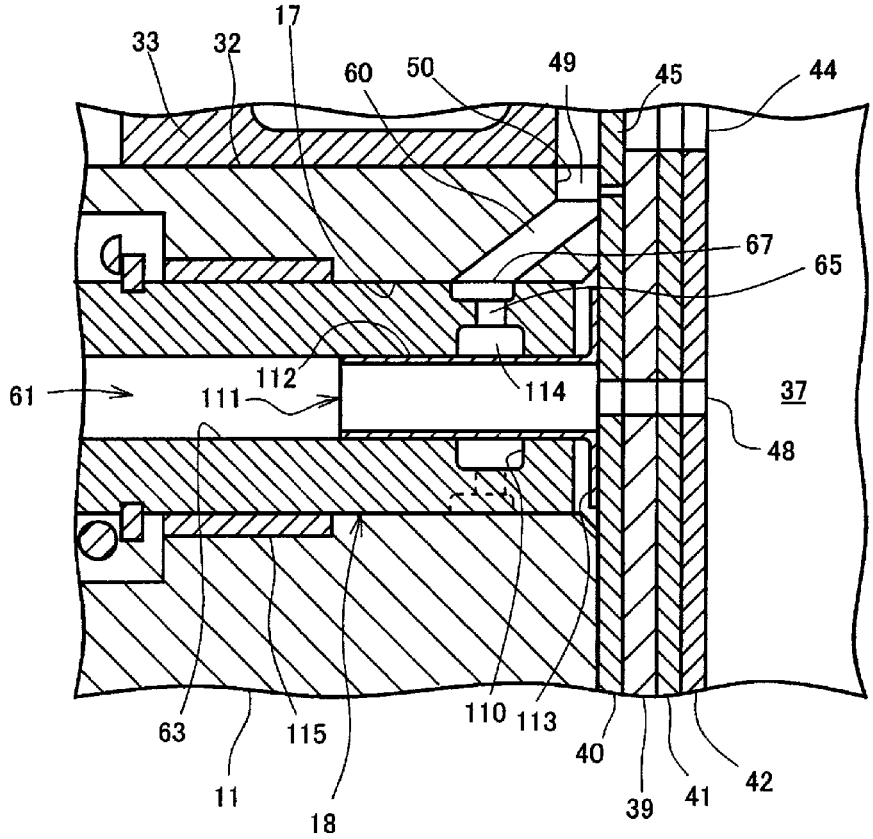
FIG. 9(*a*) is an enlarged longitudinal cross-sectional view showing a substantial part of the compressor according to the fifth embodiment.
Figure 9B:
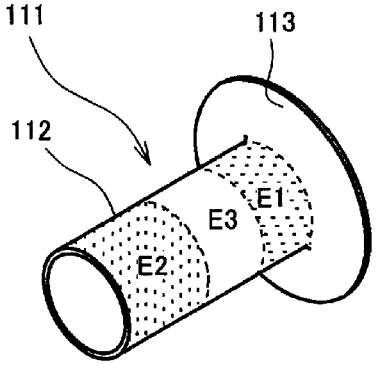

In the compressor of this embodiment, the drive shaft 18 is rotationally supported on the cylinder block 11 via a radial bearing 115 as shown in FIG. 8. As shown in FIGS. 9(*a*) and 9(*b*), the communication hole 61 is formed to have the same diameter as the small diameter hole portion 63 of the first embodiment, uniformly from the rear end portion to the front end portion thereof. As shown in FIG. 9(*a*), an annular recessed portion 110 is formed in the inner wall of the drive shaft 18 forming the communication hole 61. The annular recessed portion 110 is recessed radially from the communication hole 61 toward the outer peripheral surface of the drive shaft 18 and is formed on the entire periphery of the inner wall of the drive shaft 18 forming the communication hole 61 to be in communication with the high-pressure connection hole 65 and the low-pressure connection hole 66.

A cylindrical body 111 of this embodiment is a shaft stopper for limiting the rearward movement of the drive shaft 18 and includes a cylindrical portion 112 having a uniform outside diameter dimension. The outside diameter dimension of the cylindrical portion 112 is set to be press-fittable into the communication hole 61. A radially extending annular portion 113 is formed at one end portion of the cylindrical portion 112. The trailing fitting portion E1 is formed as a press-fitting portion on the outer peripheral surface of the cylindrical body 111 near the annular portion 113 in the axial direction. The leading fitting portion E2 is formed as a press-fitting portion on the outer peripheral surface of the cylindrical body 111 in the end portion opposite to the annular portion 113. Further, the space-facing portion E3, which faces the annular recessed portion 110, is formed on the outer peripheral surface of the cylindrical body 111 between the trailing fitting portion E1 and the leading fitting portion E2.

With the cylindrical body 111 being fixed by press-fitting to the drive shaft 18, the annular recessed portion 110 and the cylindrical portion 112 forms an annular space 114. The annular space 114 corresponds to the annular space 75 of the first embodiment.

This embodiment achieves the same advantages as (1) and (4) to (7) in the first embodiment. Moreover, two portions of the cylindrical portion 112, that is, the trailing fitting portion E1 and the leading fitting portion E2 are the portions to be press-fitted into the drive shaft 18 and the cylindrical portion 112 is set to have a uniform outside diameter dimension, whereby the cylindrical body 111 can be produced easily.

The respective above-described embodiments (including the modification) are only for illustration purposes and the present invention is not limited to the embodiments, but may be variously modified within the spirit and scope of the invention as follows.

The cylindrical bodies 70, 80, 90, 100 and 111, which are shaft stoppers in the respective above-described embodiments, are not limited to serve as shaft stoppers. The cylindrical bodies 70, 80, 90, 100 and 111 do not necessarily need to serve as shaft stoppers when another arrangement for limiting the axial movement of the drive shaft 18 is provided.

The high-pressure opening portion 67 and the low-pressure opening portion 68, which are formed in an elongated circular shape in the respective above-described embodiments, but the shape is not limited to an elongated circular shape. The high-pressure opening portion 67 and the low-pressure opening portion 68 may be formed in, for example, a circular shape. Also, the cross-section of the high-pressure connection hole 65 and the low-pressure connection hole 66 is not limited to a circular shape, but may be formed in an oval shape or an elliptical shape.

The piston-type compressors, which are described as a swash plate-type variable displacement compressor in the respective above-described embodiments, may be a swash plate-type fixed displacement compressor or a wobble-type variable displacement compressor. The piston-type compressors are also not limited to air-conditioning compressors for a vehicle.

The low-pressure connection hole 66, which is arranged to be in communication with the cylinder bore 32 in which a compression stroke is executed in the respective above-described embodiments, may be in communication with the cylinder bore 32 in which a suction stroke is executed.

The communication passages 60, which are arranged to be formed in the cylinder block 11 in the above-described embodiments, may be formed in the rear housing member 13 or another member if the valve mechanism protrudes from the rear end of the cylinder block 11.

The sealing member, which is arranged to be provided in the cylindrical bodies 70, 80, 90, 100 and 111 or in the drive shaft 18 in the above-described second and third embodiments, may be provided both in the cylindrical bodies 70, 80, 90, 100 and 111 and in the drive shaft 18 by combining the second and third embodiments.

The coating layer containing lubricant, which is formed on the outer peripheral surface of the drive shaft 18 in sliding contact with the cylinder block 11 in the above-described embodiments excluding the fifth embodiment, may contain solid lubricant such as molybdenum disulfide. The coating layer may also contain binder resin such as polyamide-imide resin or polyimide resin, inorganic particles such as titanium dioxide, and coupling agent such as silane coupling agent.

The radial bearing 23, which is used to rotationally support the drive shaft 18 on the cylinder block 11 in the above-described fifth embodiment, may be omitted in the first to fourth embodiments. Alternatively, in the first to fourth embodiments, the drive shaft 18 may be rotationally supported on the cylinder block 11 via a radial bearing 23.

Therefore, the present examples and embodiments are to be considered as illustrative and not restrictive and the invention is not to be limited to the details given herein, but may be modified within the scope and equivalence of the appended claims.

The invention claimed is:

1. A piston-type compressor comprising:

a housing having a shaft hole and a plurality of cylinder bores provided around the shaft hole;

a drive shaft inserted and rotationally supported in the shaft hole;

a plurality of pistons inserted in respective cylinder bores of the plurality of cylinder bores, wherein the pistons are caused to reciprocate within the respective cylinder bores by a rotation of the drive shaft;

a plurality of communication passages providing a communication between the plurality of cylinder bores and the shaft hole;

a valve mechanism arranged to operate integrally with the drive shaft in the shaft hole and including a residual gas bypass passage in communication with the plurality of communication passages to guide a residual gas in one cylinder bore of the plurality of cylinder bores to a second cylinder bore of the plurality of cylinder bores;

a communication hole formed inside the drive shaft; and a cylindrical body inserted in the communication hole to disconnect the residual gas bypass passage and the communication hole from each other and to open an interior space of the cylindrical body to the communication hole, wherein the valve mechanism includes an annular space defined outside the cylindrical body in the communication hole, wherein the annular space extends around an entire circumference of the cylindrical body, and a plurality of connection holes providing communication between the annular space and the communication passages, and the residual gas bypass passage comprises the annular space and the connection holes.

2. The piston-type compressor according to claim 1, wherein the housing includes a cylinder block, and the communication passages are formed in the cylinder block.

3. The piston-type compressor according to claim 2, further comprising a valve forming plate joined to an end surface of the cylinder block, wherein the cylindrical body serves as a shaft stopper that contacts the valve forming plate and limits an axial movement of the drive shaft toward the valve forming plate.

4. The piston-type compressor according to claim 1, wherein the cylindrical body includes a leading fitting portion, which is fitted to the drive shaft to be located on a leading side in an insertion direction, a trailing fitting portion, which is fitted to the drive shaft to be located on a trailing side in the insertion direction, and a space-facing portion, which is positioned between the leading fitting portion and the trailing fitting portion and faces the annular space, and wherein at least one of the leading fitting portion and the trailing fitting portion is fixed by press-fitting to the drive shaft.

5. The piston-type compressor according to claim 4, wherein the communication hole includes a first hole portion extending from a first end towards a second end of the drive shaft and having a first inner diameter and a second hole portion extending from the first hole portion towards the second end and having a second inner diameter smaller than the first inner diameter of the first hole portion, the cylindrical body includes a first cylindrical portion fitted to the drive shaft in the first hole portion and a second cylindrical portion fitted to the drive shaft in the second hole portion, the leading fitting portion and the space-facing portion are provided in the second cylindrical portion, and the trailing fitting portion is provided in the first cylindrical portion.

6. The piston-type compressor according to claim 4, further comprising a sealing portion provided in the leading fitting portion or the trailing fitting portion to seal a boundary between the drive shaft and the cylindrical body.

7. The piston-type compressor according to claim 1, wherein the housing includes a suction chamber and a control pressure chamber, and the communication hole and the interior space of the cylindrical body provide a communication between the suction chamber and the control pressure chamber.

8. The piston-type compressor according to claim 1, wherein the annular space is defined radially between an inner circumferential surface of the drive shaft and an outer circumferential surface of the cylindrical body.

* * * * *